US005431349A

United States Patent [19]

Purser

[11] Patent Number: 5,431,349

[45] Date of Patent: Jul. 11, 1995

[54] SELF-CONTAINED MOBILE SCRAP FRAGMENTIZER

[76] Inventor: Brian Purser, Caverswall Common, Stoke-on-Trent ST11 9EX, England

[21] Appl. No.: 62,900

[22] Filed: May 18, 1993

[51] Int. Cl.[6] ..... B02C 21/02

[52] U.S. Cl. ..... 241/101.72; 241/222; 241/243; 241/273.3

[58] Field of Search ..... 241/101.7, 222, 242, 241/260.1, 273.3, 243

[56] References Cited

U.S. PATENT DOCUMENTS

| | | | |
|---|---|---|---|
| 3,335,967 | 8/1967 | Williams | 241/35 |
| 3,608,837 | 9/1971 | Panning et al. | 241/36 |
| 3,859,910 | 1/1975 | Swanson, Jr. | 100/100 |
| 3,931,841 | 1/1976 | Blum | 144/309 R |
| 4,015,782 | 4/1977 | Granite | 241/62 |
| 4,236,554 | 12/1980 | Nicholson | 144/34 R |
| 4,884,757 | 12/1989 | Streicher | 241/222 |
| 5,158,126 | 10/1992 | Lang | 144/375 |

*Primary Examiner*—Mark Rosenbaum
*Assistant Examiner*—John M. Husar
*Attorney, Agent, or Firm*—W. Thad Adams, III

[57] ABSTRACT

A mobile self-contained scrap fragmentizer for reducing light scrap metal structures into small pieces of scrap metal. The apparatus includes an apparatus housing having a scrap-receiving opening for receiving the metal structures to be fragmentized, and a discharge opening for discharging fragmentized pieces of scrap metal. The apparatus is attached to a vehicle having a source of hydraulic power. A feed roller and fragmentizing rotor are powered by the source of hydraulic power for feeding metal structures in the scrap-receiving opening into the apparatus housing and for fragmentizing the metal structures into small pieces of scrap metal. The fragmentized metal structures are discharged through a discharge opening in small pieces ready for further processing.

13 Claims, 3 Drawing Sheets

SELF-CONTAINED MOBILE SCRAP FRAGMENTIZER

TECHNICAL FIELD AND BACKGROUND OF THE INVENTION

This invention relates to a self-contained mobile scrap fragmentizer. In the embodiment disclosed in this application, the fragmentizer is intended to be constructed as an attachment to a hydraulic-powered vehicle such a backhoe. The hydraulic power supply of the backhoe is used to power the self-contained scrap fragmentizer.

The purpose of the apparatus is to reduce large volume light steel and other metal structures into small, chopped-up pieces of scrap metal which are therefore very dense, compact and easy to transport. Scrap iron and steel is sold by the ton. The more scrap per unit of volume, the easier and less expensive per ton to transport. This fact provides a substantial incentive for scrap to be reduced to a dense form before resale and recycling.

Light steel (sheet steel) is used for structures which enclose large volumes of empty space, for example, oil drums. The value of oil drums as scrap is very low because of the relatively low weight which can be transported in a single load, on, for example, a truck or rail car. In other words, when transporting, for example, empty oil drums, it is mostly air which is being transported. However, when chopped or fragmentized into small pieces, a very substantial quantity of light steel can be transported in a single load. Its value as scrap is therefore greatly increased.

The present invention is intended to fragmentize into suitable small pieces of scrap such things as oil drums, discarded washing machines, stoves, dishwashers, water heaters, refrigerators, file cabinets, car and truck bodies and many other sheet steel products.

Presently, such products are reduced to scrap by a "fragmentizer"—a stationary machine which can occupy up to one-half acre and cost between four and seven million dollars. Such fragmentizers are powered by a 1000 to 3000 horsepower electric or diesel electric motor, and therefore use large quantities or electric power or diesel fuel.

Fragmentizers create large amounts of dust and noise and present a high visual profile. The machines operate at very high speeds of up to 900 rpm of the main rotor, and therefore require considerable maintenance. The main rotor has a number of swinging hammers which flail at the steel structure and pound it into fragments by knocking lumps of metal off of the scrap. This causes extensive wear on the fragmentizer. Such fragmentizers can produce between 500 and 1200 tons of scrap per 40 hour week. The scrap must be transported to the fragmentizer since it is stationary.

In contrast, the invention according to this application uses energy already available from the hydraulic system of a vehicle such as a backhoe or similar type of construction equipment. The main rotor runs at a much slower speed, and cuts the steel rather than pounding it to bits. This creates much less noise and wear. The compact size of the apparatus permits it to be moved to locations where the scrap is located. An apparatus according to the present invention can very inexpensively produce about 200 tons of scrap per 40 hour week.

SUMMARY OF THE INVENTION

Therefore, it is an object of the invention to provide a mobile self-contained scrap fragmentizer.

It is another object of the invention to provide a mobile self-contained scrap fragmentizer which can be attached to the boom of a vehicle such as a backhoe excavator.

It is another object of the invention to provide a mobile scrap fragmentizer which uses the hydraulic power source of a vehicle to which it is attached.

It is another object of the invention to provide a mobile scrap fragmentizer which cuts light steel into small pieces.

It is another object of the invention to provide a mobile scrap fragmentizer which operates with relatively little noise and which uses energy efficiently.

It is another object of the invention to provide a mobile scrap fragmentizer which has a rotor which operates at relatively slow speed and thus requires relatively little maintenance.

It is another object of the invention to provide a mobile scrap fragmentizer which is relatively inexpensive.

These and other objects of the present invention are achieved in the preferred embodiments disclosed below by providing a mobile self-contained scrap fragmentizer for reducing light scrap metal structures into small pieces of scrap metal. The apparatus comprises an apparatus housing having a scrap-receiving opening for receiving the metal structures to be fragmentized, and a discharge opening for discharging fragmentized pieces of scrap metal. Attachment means are provided for attaching the apparatus housing to a vehicle having a source of hydraulic power and for supplying the source of hydraulic power to the apparatus housing. Scrap feeding means are powered by the source of hydraulic power for feeding metal structures in the scrap-receiving opening into the apparatus housing. Scrap fragmentizing means are powered by the source of hydraulic power and is positioned in the apparatus housing between the scrap feeding means and the discharge opening for fragmentizing the metal structures into small pieces of scrap metal as they are fed to the scrap fragmentizing means from the scrap feeding means. The fragmentized metal structures are discharged through a discharge opening.

According to one preferred embodiment of the invention, the scrap feeding means comprises a feed roller positioned in the scrap-receiving opening and rotating in a direction to push the scrap metal structures under the feed roller and into the apparatus housing.

According to another preferred embodiment of the invention, the feed roller includes a plurality of metal creasing and cutting members positioned on a peripheral surface of the feed roller.

According to yet another preferred embodiment of the invention, the metal creasing and cutting members comprise an annular blade extending around the peripheral surface of the feed roller in spaced-apart relation to each other.

According to yet another preferred embodiment of the invention, the scrap fragmentizing means comprises a fragmentizing rotor having fragmentizing teeth positioned on a peripheral surface. The fragmentizing teeth are hardened steel and are positioned in spaced-apart staggered relation on the peripheral surface of the fragmentizing rotor along the axial length thereof.

Preferably, the teeth have a relatively large base proximal to the fragmentizing rotor by which the teeth of attached to the peripheral surface of the fragmentizing rotor, and a distal cutting blade, the longitudinal axis of the blade extending in the direction of the axis of rotation of the fragmentizing rotor.

According to one preferred embodiment of the invention, the scrap fragmentizer includes at least one hydraulic motor hydraulically connected to the source of hydraulic power of the vehicle.

According to another preferred embodiment of the invention, the apparatus housing includes a plurality of wear ribs in the scrap-receiving opening.

According to yet another preferred embodiment of the invention, the invention includes adjustment means for adjusting the size of the scrap-receiving opening relative to the feed roller.

According to yet another preferred embodiment of the invention, the adjustment means comprise mounting means for mounting the feed roller for rotation on opposing first and second side walls of the apparatus housing. First and second load springs are carried by respective ones of the first and second side walls and urge the feed roller into proper adjustment while permitting controlled translational movement of the feed roller as metal structures pass underneath the feed roller.

According to yet another preferred embodiment of the invention, the scrap feeding means comprises a feed roller positioned in the scrap-receiving opening and rotating in a direction to push the scrap metal structures under the feed roller and into the apparatus housing. The scrap fragmentizing means comprises a fragmentizing rotor having fragmentizing teeth positioned on a peripheral surface thereof. The scrap fragmentizer includes at least one hydraulic motor hydraulically connected to the source of hydraulic power of the vehicle.

According to yet another preferred embodiment of the invention, chain drive means are provided for transmitting rotation from the hydraulic motor to the feed roller and the fragmentizing rotor.

Preferably, the invention includes an anvil for supporting the scrap metal as it is engaged by the fragmentizing rotor and the fragmentizing teeth thereon.

Preferably, the vehicle to which the invention is attached comprises a backhoe.

BRIEF DESCRIPTION OF THE DRAWINGS

Some of the objects of the invention have been set forth above. Other objects and advantages of the invention will appear as the invention proceeds when taken in conjunction with the following drawings, which.

DESCRIPTION OF THE PREFERRED EMBODIMENT AND BEST MODE

Figure 1:
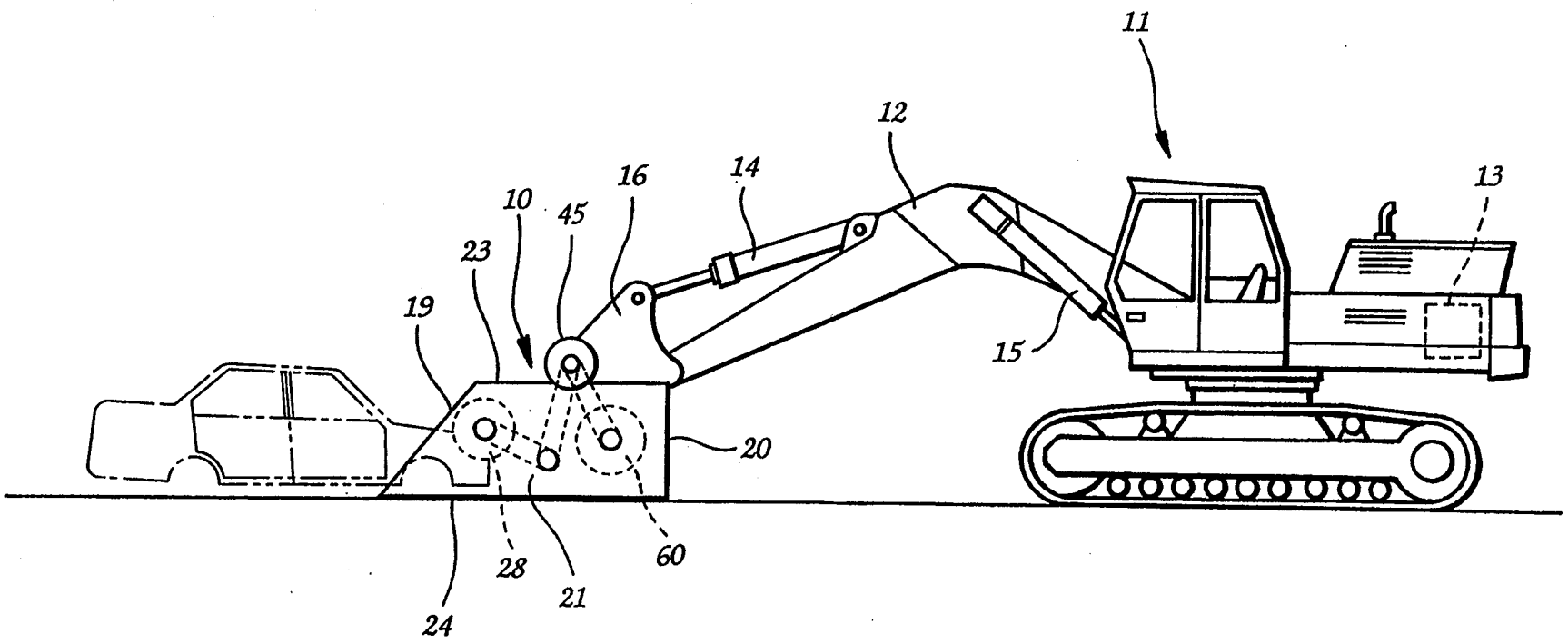
FIG. 1 is a side elevation of the mobile scrap fragmentizer according to an embodiment of the invention, connected to a backhoe.

Referring now specifically to the drawings, a mobile scrap fragmentizer according to the present invention is illustrated in FIG. 1 and shown generally at reference numeral 10. The mobile scrap fragmentizer 10 is attached to a backhoe vehicle 11 having a boom 12 which normally carries a backhoe or other excavating implement. Backhoe vehicle 11 includes a hydraulic system 13 which supplies hydraulic power to the boom 12 and to the excavating or other implement. Boom 12 includes hydraulic cylinder assemblies 14 and 15 which permit the boom 12 to be manipulated.

Boom 12 has a mounting bracket 16 mounted on the end, and onto which is mounted the backhoe in its conventional usage, and when used as illustrated in FIG. 1, the mobile scrap fragmentizer 10. As is shown in FIG. 1, the mobile scrap fragmentizer 10 can be positioned wherever desired and used to process light scrap metal, such as the car body shown. In such instances, the engine block, transmission housings, axles and other heavy steel members are first removed from the car body before processing begins.

The mobile scrap fragmentizer 10 may be placed at ground level, or may be positioned substantially above ground level if desired, and positioned over a dump truck or rail car, so that processed scrap from the mobile scrap fragmentizer 10 is discharged directly into a transport vehicle which can be moved away when full. Conversely, the mobile scrap fragmentizer 10 can easily be moved from place to place as scrap processing takes place.

Figure 2:
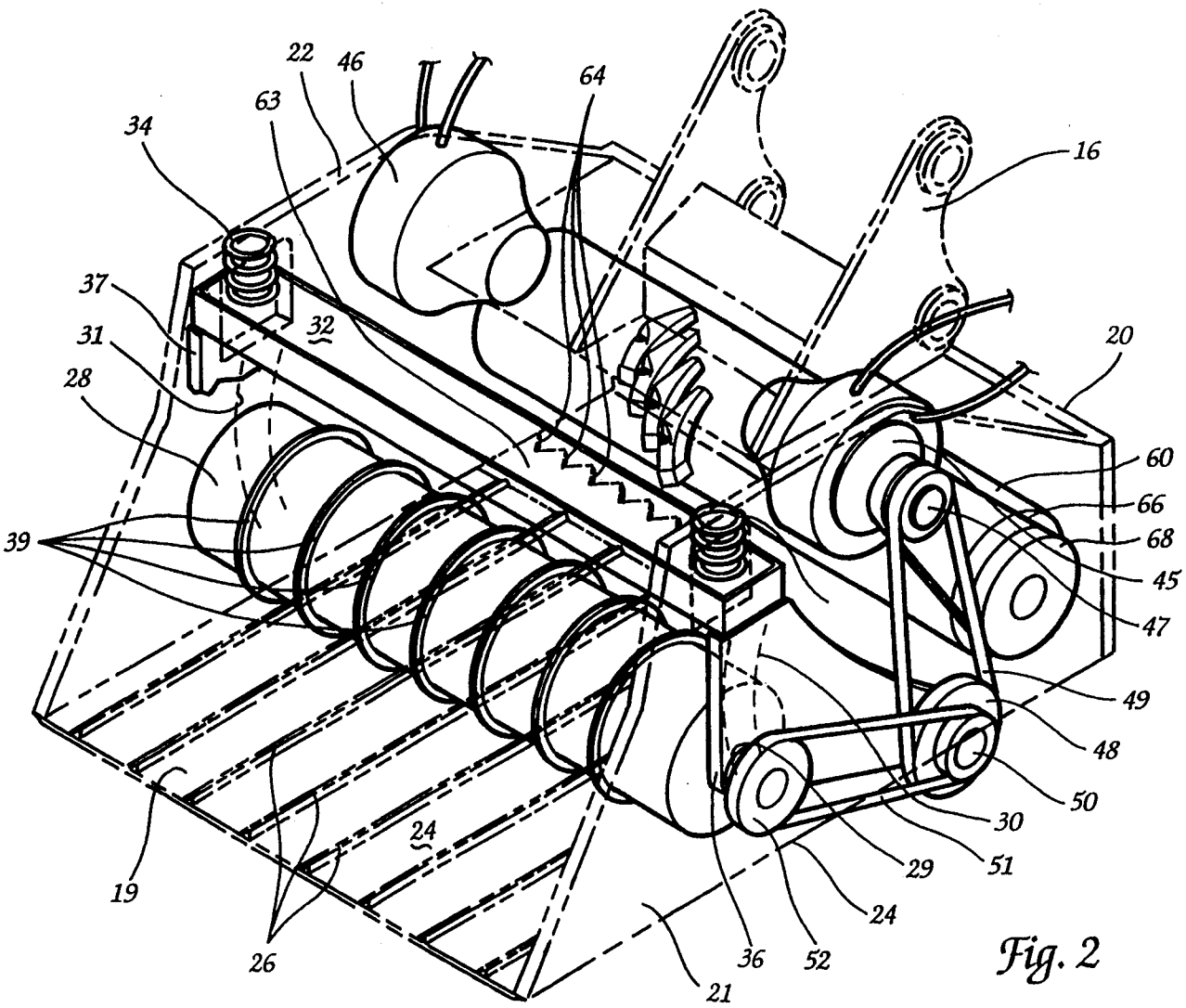
FIG. 2 is an enlarged perspective view of the mobile scrap fragmentizer shown in FIG. 1, with parts broken away for clarity.

Referring now to FIG. 2, mobile scrap fragmentizer 10 has a housing which includes a scrap-receiving opening 19 on the front end, a discharge opening 20 on the rear end, opposed sidewalls 21 and 22 and opposed top and bottom walls 23 and 24. The bottom wall 24 extends forward to form a "scoop" which will support metal structures as they are being fed into the opening 19. Wear ribs 26 reduce wear on the bottom wall 24 and also reduce friction between the bottom wall 24 and the scrap as it is fed into the opening 19. Scrap is pulled into the mobile scrap fragmentizer 10 by a feed roller 28. Feed roller 28 is mounted for rotation on an axle 29 which rides in curved adjustment slots 30 and 31 in side walls 21 and 22, respectively. In the embodiment shown in the drawings, feed roller 28 has a diameter of 18 inches (46 cm). A torque beam 32 carries a pair of high resistance load springs 33 and 34 which spring load feed roller 28. Feed roller 28 cooperates with the load springs through a pair of mounting brackets 36 and 37.

Feed roller 28 includes several raised ribs 39 which extend around the periphery of the feed roller 28 and which crease the metal as it feeds into the mobile scrap fragmentizer 10. The ribs 39 also do some cutting, weakening and bending of the metal and generally provide a preliminary processing step to the major cutting which will subsequently take place. The ribs also provide enhanced gripping of the metal as it is pulled into the mobile scrap fragmentizer 10, and cooperate with the wear ribs 26 on the bottom wall 24 to provide positive engagement against the metal as its reduction to scrap begins. Thus, the ribs 26 and 39 cooperate to begin the scrap-generating process and provide positive gripping to insure that the metal is fed properly into the mobile scrap fragmentizer 10.

Feed roller 28 is driven by a pair of hydraulic motors 45 and 46 which are powered by hydraulic fluid from the hydraulic power system 13 of the excavator vehicle 11. A single hydraulic motor may also be used. A drive gear 47 powered by hydraulic motor 45 transmits rotary motion to a driven gear 48 through a drive chain 49. The rotational speed of the hydraulic motor 45 is stepped down by a concentric driven gear 50 of reduced diameter, which in turn transmits rotary motion through a drive chain 51 to a gear 52 mounted on the end of axle 29. Hydraulic motor 46 functions in exactly the same way as described above and therefore will not be separately described.

Figure 3:
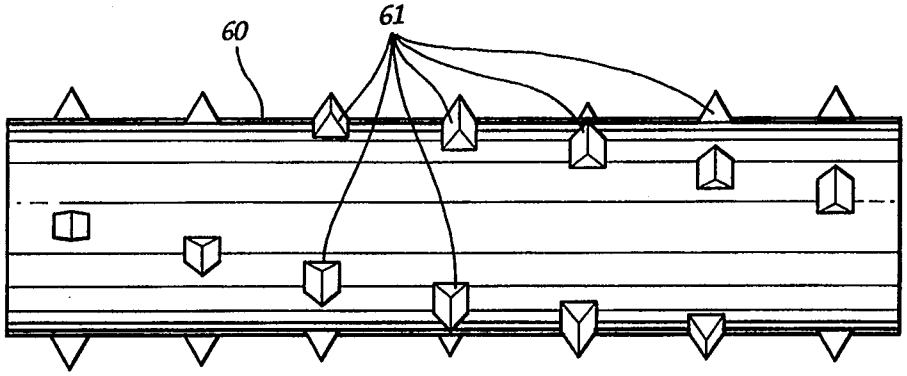
FIG. 3 is a side elevation of the fragmentizer roller.
Figure 4:
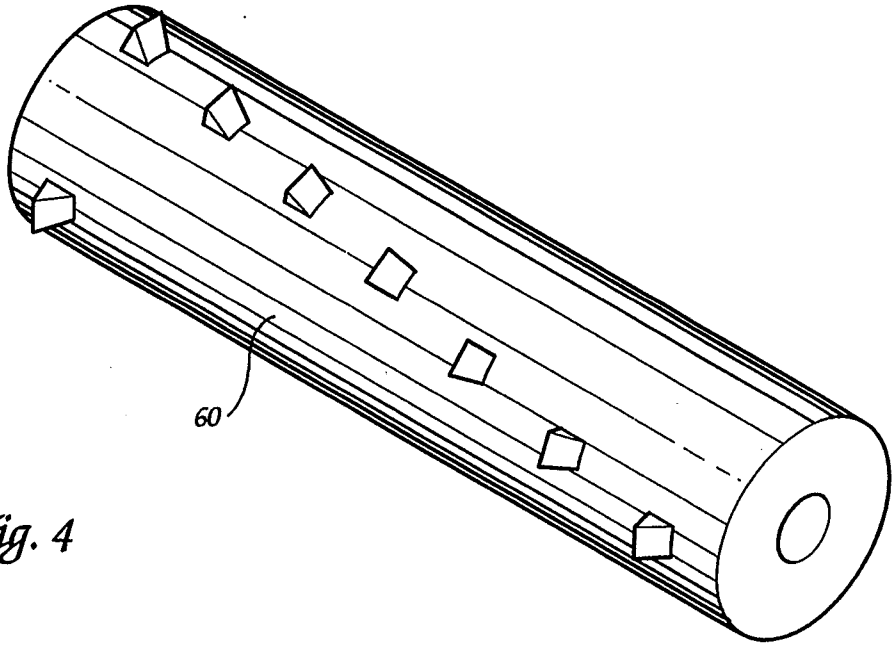
FIG. 4 is a simplified perspective view of the fragmentizer roller shown in FIG. 3.

The primary fragmentizing function of the mobile scrap fragmentizer 10 is carried out by a fragmentizing rotor 60. In the embodiment disclosed in this application, the fragmentizing rotor 60 has a diameter of 21 inches (53 cm). The fragmentizing rotor 60 is mounted for rotation in the downstream end of the mobile scrap fragmentizer 10 adjacent the discharge opening 20. Referring now to FIGS. 3 and 4, the fragmentizing rotor 60 is provided with four axially-extending rows of fragmentizing teeth 61. Each of the fragmentizing teeth 61 is relatively wide at its base. The sides of each of the teeth 61 converge to form a distal blade aligned with the direction of rotation of the fragmentizing rotor 60, and which slice into the metal as the fragmentizing rotor 60 rotates. The teeth 61 may be welded or bolted onto the peripheral surface of the fragmentizing rotor 60. The teeth are formed of hardened steel. Note that the rows of teeth 61 are staggered row by row, so that a single row of teeth progressively extends tooth-by-tooth approximately 85 degrees around the circumference of the fragmentizing rotor 60. This arrangement provides a much smoother and more efficient fragmentizing action, since a piece of metal is being progressively impacted and fragmentized along the length of the fragmentizing rotor 60, instead of being impacted all at once along its entire width.

Fragmentizing teeth 61 cooperate with an anvil 63 which is formed on the back edge of the bottom wall 24 below the fragmentizing rotor 60. Anvil 63 includes a series of serrations 64 which align with the teeth 61 on fragmentizing rotor 60. The spacing between the serrations 64 and adjacent teeth 61 is quite close—on the order of 0.01 inches (0.0254 cm). Ideally, only one tooth 61 is cutting at any given instant, thereby maximizing the force that tooth 61 can apply to the metal. Of course, two or more teeth 61 can be made to cut at a single instant, particularly if the material is relatively thin or soft.

The impact of the teeth 61 and the fragmentizing rotor 61 drives the metal being fragmentized against the anvil 63, and the rotation of the shedding rotor 60 causes the metal to be driven into and past the serrations 64, causing further fragmentizing of the metal, and completing the fragmentizing operation. During cutting, the teeth 61 are moving in the same direction as the metal being fragmentized, thereby preventing the metal from being bunched or merely crimped instead of being cleanly cut. Fragmentized metal is discharged through the discharge opening 20 and onto the ground or into whatever container is placed under and behind the discharge opening 20 to receive the fragmentized metal.

Referring again to FIG. 2, fragmentizing rotor 60 is driven by the hydraulic motors 45 and 46. As with the feed roller 28, a single hydraulic motor may be used. Fragmentizing rotor 60 is driven through drive gear 47 and a drive chain 66 which provides rotational motion to a driven gear 68 mounted on one end of fragmentizing rotor 60. Hydraulic motor 46 functions in exactly the same way as described above and therefore is not separately described. Fragmentizing rotor 60 rotates faster than the feed roller 28—on the order of 5% faster. This has the effect of pulling the scrap metal between the feed roll 28 and the fragmentizing rotor 60 into the fragmentizing rotor 60 and anvil 63, and further discharging the fragmentized metal from the fragmentizing rotor 60 and anvil 63 into the discharge opening 20. The tears and cuts made by the teeth 61 and the serrations 64 are thus widened, and incomplete tears and cuts are completed. The scrap metal discharged from the mobile scrap fragmentizer 10 is therefore in small, separate pieces with do not require further fragmentizing before being sent to a steel mill for remelting. The small, separate pieces are easily separated at subsequent steps where steel is segregated from aluminum, plastic and other components of the scrap contents.

It should be emphasized that the scrap metal in the above-described process is being cut into pieces, not hammered into pieces. The simultaneous operation of the feed roller 28, the fragmentizing rotor 60 and the anvil 63 create maximum cutting force with relatively little noise in comparison with known fragmentizers which rely on hammers to knock chunks of metal off of larger pieces.

The mobile scrap fragmentizer 10 illustrated in this application is of a size and power to receive and process a typical car body. Thus, the opening 19 is approximately five and one-half feet (1.5 meters) wide and approximately five feet (1.5 meters) high. The number and spacing of the teeth 61, the speed of rotation of the feed roller 28 and the fragmentizing rotor 60 are, of course, a matter of choice which the responsible engineer will select to fit particular circumstances. Of course, smaller scrap metal objects can easily be processed in a mobile scrap fragmentizer large enough to process much larger metal objects. If desired, fragmentizing rotors with different sized, spaced and shaped teeth can be provided, and installed on a single mobile scrap fragmentizer as desired to optimize processing of particular types of scrap on a given mobile scrap fragmentizer.

A much smaller and lower-powered mobile scrap fragmentizer 10 can be engineered especially to process, for example, discarded appliances or oil drums. Much larger and higher-powered units can also be engineered to process truck bodies and large storage tanks. In each case, the size and power needed is determined from the scrap metal to be processed and the vehicle providing the hydraulic power.

A mobile scrap fragmentizer is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A mobile self-contained scrap fragmentizer for reducing light scrap metal structures into small pieces of scrap metal, comprising:

(a) an apparatus housing having a scrap-receiving opening for receiving the metal structures to be fragmentized, and a discharge opening for discharging fragmentized pieces of scrap metal;

(b) attachment means for attaching the apparatus housing to a vehicle having a source of hydraulic power and for supplying said source of hydraulic power to said apparatus housing:

(c) scrap feeding means powered by said source of hydraulic power for feeding the metal structures in the scrap-receiving opening into the apparatus housing;

(d) scrap fragmentizing means powered by said source of hydraulic power and positioned in said apparatus housing between said scrap feeding means and said discharge opening for fragmentizing the metal structures into small pieces of scrap metal as they are fed to the scrap fragmentizing means from the scrap feeding means, and for discharging the fragmentized metal structures through the discharge opening, said scrap fragmentizing means comprising a rotor having a plurality of outwardly-extending triangular teeth positioned in staggered relation around the periphery of the rotor, each of said teeth being radially aligned with the direction of rotation of said rotor; and (e) an anvil positioned between the scrap feeding means and the rotor, said anvil having a serrated edge defined by plurality of laterally-extending triangular-shaped serrations positioned in corresponding alignment with respective ones of said triangular teeth; the triangular shape of said teeth and the triangular shape of said anvil intersecting to cause passage of said teeth past respective ones of said serrations in closely spaced-apart metal fragmentizing relation to each other.

2. A mobile self-contained scrap fragmentizer according to claim 1, wherein said scrap feeding means comprises a feed roller positioned in the scrap-receiving opening and rotating in a direction to push the scrap metal structures under the feed roller and into the apparatus housing.

3. A mobile self-contained scrap fragmentizer according to claim 2, wherein said feed roller includes a plurality of metal creasing and cutting members positioned on a peripheral surface of the feed roller.

4. A mobile self-contained scrap fragmentizer according to claim 3, wherein said each of said metal creasing and cutting members comprises an annular blade extending around the peripheral surface of the feed roller in spaced-apart relation to each other.

5. A mobile self-contained scrap fragmentizer according to claim 2, wherein said apparatus housing includes a plurality of wear ribs in the scrap-receiving opening.

6. A mobile self-contained scrap fragmentizer according to claim 2, and including adjustment means for adjusting the size of the scrap receiving opening relative to the feed roller.

7. A mobile self-contained scrap fragmentizer according to claim 6, wherein said adjustment means comprise:

(a) mounting means for mounting said feed roller for rotation on opposing first and second side walls of said apparatus housing;

(b) first and second load springs carried by respective ones of said first and second side walls and urging said feed roller into proper adjustment while permitting controlled translational movement of said feed roller as metal structures pass underneath the feed roller.

8. A mobile self-contained scrap fragmentizer according to claim 1, wherein said fragmentizing teeth comprise hardened steel.

9. A mobile self-contained scrap fragmentizer according to claim 8, wherein said teeth have a relatively large base proximal to said fragmentizing roller by which the teeth of attached to the peripheral surface of the fragmentizing roller and a distal cutting blade, the longitudinal axis of said blade extending in the direction of the axis of rotation of the fragmentizing roller.

10. A mobile self-contained scrap fragmentizer according to claim 1, wherein scrap fragmentizer includes at least one hydraulic motor hydraulically connected to said source of hydraulic power of the vehicle.

11. A mobile self-contained scrap fragmentizer according to claim 1, wherein said scrap feeding means comprises a feed roller positioned in the scrap-receiving opening and rotating in a direction to push the scrap metal structures under the feed roller and into the apparatus housing; said scrap fragmentizing means comprises a fragmentizing roller having fragmentizing teeth positioned on a peripheral surface thereof; said scrap fragmentizer including at least one hydraulic motor hydraulically connected to said source of hydraulic power of the vehicle, and further including chain drive means for transmitting rotation from said hydraulic motor to said feed roller and said fragmentizing roller.

12. A mobile self-contained scrap fragmentizer according to claim 1, wherein said vehicle comprises a backhoe.

13. A mobile self-contained scrap fragmentizer for reducing light scrap metal structures into small pieces of scrap metal, comprising:

(a) an apparatus housing having a top wall, first and second opposing and spaced-apart sidewalls, and a bottom wall opposing and spaced-apart from said top wall, said top wall, said bottom wall and said sidewalls defining a scrap-receiving opening for receiving the metal structures to be fragmentized and also defining a discharge opening through which fragmentized pieces of scrap metal are discharged;

(b) attachment means for attaching the apparatus housing to a vehicle having a source of hydraulic power and for supplying said source of hydraulic power to said apparatus housing;

(c) a feed roller powered by said source of hydraulic power for feeding the metal structures in the scrap-receiving opening into the apparatus housing;

(d) a scrap fragmentizing roller powered by said source of hydraulic power and positioned in said apparatus housing between said scrap feeding roller and said discharge opening for fragmentizing the metal structures into small pieces of scrap metal as they are fed to the scrap fragmentizing roller from the scrap feeding roller and for discharging the fragmentized metal structures through the discharge opening, said scrap fragmentizer further comprising a rotor having a plurality of outwardly-extending triangular teeth positioned in staggered relation around the periphery of the rotor each of said teeth being radially aligned with the direction of rotation of said rotor; and (e) an anvil positioned between the scrap feeding means and the rotor, said anvil having a serrated edge defined by a plurality of laterally-extending triangular-shaped serrations positioned in corresponding alignment with respective ones of said triangular teeth; the triangular shape of said teeth and the triangular shape of said anvil intersecting to cause passage of said teeth past respective ones of said serrations in closely spaced-apart metal fragmentizing relation to each other.

* * * * *